US007044460B2

(12) United States Patent
Bolton

(10) Patent No.: US 7,044,460 B2
(45) Date of Patent: May 16, 2006

(54) CONCEALED FASTENER, SYSTEM, AND ASSOCIATED METHODS

(76) Inventor: Carl William Bolton, 2110 De La Vina #2, Santa Barbara, CA (US) 93105

( * ) Notice: Subject to any disclaimer, the term of this patent is extended or adjusted under 35 U.S.C. 154(b) by 244 days.

(21) Appl. No.: 10/414,057

(22) Filed: Apr. 15, 2003

(65) Prior Publication Data

US 2003/0221391 A1 Dec. 4, 2003

Related U.S. Application Data

(60) Provisional application No. 60/372,735, filed on Apr. 16, 2002.

(51) Int. Cl.
*B25B 1/20* (2006.01)

(52) U.S. Cl. ..... 269/37

(58) Field of Classification Search ..... 269/37, 269/289 R, 290, 291, 303, 309, 139
See application file for complete search history.

(56) References Cited

U.S. PATENT DOCUMENTS

| | | | | |
|---|---|---|---|---|
| 1,936,028 | A | 11/1933 | Rockwell | |
| 2,994,878 | A | 8/1961 | Abrahamsen | |
| 3,496,974 | A | 2/1970 | Munsil et al. | |
| 3,788,632 | A * | 1/1974 | Lukas | 269/20 |
| 4,620,403 | A | 11/1986 | Field | |
| 4,742,856 | A * | 5/1988 | Hehr et al. | 144/371 |
| 4,965,980 | A | 10/1990 | Leavens | |
| 5,027,573 | A | 7/1991 | Commins et al. | |
| 5,322,396 | A | 6/1994 | Blacker | |
| 5,507,607 | A | 4/1996 | Ericksen et al. | |
| 5,590,986 | A | 1/1997 | Juang | |
| 5,649,661 | A | 7/1997 | Masuno et al. | |
| 5,743,684 | A | 4/1998 | Rex | |
| 5,775,048 | A | 7/1998 | Orchard | |
| 5,868,183 | A * | 2/1999 | Kozyrski et al. | 144/136.1 |
| 5,906,539 | A * | 5/1999 | Tabel | 451/403 |
| 5,997,209 | A | 12/1999 | Sachs | |
| 6,071,054 | A | 6/2000 | Tebo | |
| 6,283,685 | B1 | 9/2001 | Lemieux | |
| 6,286,742 | B1 | 9/2001 | Mukoyama | |
| 6,394,712 | B1 | 5/2002 | Weinstein et al. | |
| 6,402,415 | B1 | 6/2002 | Eberle, III | |
| 6,481,937 | B1 * | 11/2002 | Sommerfeld et al. | 408/115 R |
| D470,039 | S | 2/2003 | Pelc | |
| 2001/0038026 | A1 | 11/2001 | Dickhaut | |

OTHER PUBLICATIONS

Lumber Loc. Datasheet. KK Mfg. Co, Inc., Overland Park, Kansas, Jun. 2002.
i-Clip. Datasheet. DLH Nordisk, Taastrup, Denmark, acknowledged prior art.
USP Structural Connectors. Datasheet. A Gibraltar Company, Minneapolis, Minnesota, acknowledged prior art.

* cited by examiner

*Primary Examiner*—Lee D. Wilson
(74) *Attorney, Agent, or Firm*—Allen, Dyer, Doppelt, Milbrath & Gilchrist, P.A.

(57) ABSTRACT

A device for affixing a decking member to a joist includes a jig body positionable atop a pair of spaced-apart decking members positioned atop a joist. The jig body has an angled bore having a bottom end extending through a bottom face of the jig body, the bottom end of the angled bore in communication with the space between the decking members. The angled bore defines a centerline extending through the space to a position on the side of the first structural member. The angled bore is for receiving a fastener drivable therethrough into the first structural member's side face, through the first structural member's bottom face, and into the second structural member's top face.

44 Claims, 15 Drawing Sheets

CONCEALED FASTENER, SYSTEM, AND ASSOCIATED METHODS

CROSS-REFERENCE TO RELATED APPLICATION

This application claims priority from commonly owned provisional application Ser. No. 60/372,735, filed Apr. 16, 2002, "Universal Hidden Fastening System for Decks."

BACKGROUND OF THE INVENTION

1. Field of the Invention

The present invention relates to construction systems and methods, and, more particularly, to fasteners for outdoor structures such as decks.

2. Description of Related Art

Conventional deck fastening methods incorporate the placement of fastening means, such as screws, nails, or staples, directly into the surface of the decking material, through the decking members, and into a support joist positioned beneath the decking members. This method has several shortcomings: the visible fastener heads are unsightly and detract from the appearance of the deck surface, and the surface penetration with the fasteners can lead to future problems. Such problems include those resulting from moisture penetration, causing material changes resulting in splintering, crack propagation, fungal and mold growth, and loosening of the junction between the fastener and the surrounding material. These problems can cause the decking to become loose and stained by material corrosion. In addition, the decking members can become loose, and the fastener head can protrude above the deck surface, all of which are potentially dangerous to deck users.

Several attempts have been made to address these problems, including systems that include means for concealing the fastener from the deck surface. It is believed, however, that these systems have additional problems that are addressed and solved by the present invention.

SUMMARY OF THE INVENTION

The present invention achieves the following objectives: Adequate spacing between surface members is provided for aeration; surface members are attached directly to supporting joists; individual surface members are removable after installation; variable-dimension construction materials are usable, including, but not intended to be limited to, hardwood, softwood, polymeric, and composite materials; butt joints, endings, and perpendicular and diagonally oriented surface members are fastenable; surface members are not required to be completely fastened sequentially; shrinkage of surface members does not compromise the integrity of the completed construction.

It is to be noted that, although the present disclosure addresses a construction such as an outdoor deck, the invention is not intended to be limited thereby, and one of skill in the art will recognize that additional constructions will be encompassed thereby.

The objectives listed above, and others, are achieved by the present invention, a first embodiment of which comprises a device for affixing a first structural member to a second structural member. The device comprises a base plate positionable atop a pair of first structural members that are positioned in spaced-apart relation from each other atop a second structural member. The base plate has a bore therethrough from a top surface to a bottom surface.

The device further comprises means for retaining the base plate in a desired position relative to the first structural members and a jig body positionable atop the base plate in a desired orientation. The jig body has an angled bore that has a bottom end extending through a bottom face of the jig body. The angled bore is in communication with the base plate bore, the bottom end of the angled bore is in communication with a space between the pair of first structural members, and defines a centerline extending to a position on a one of the first structural members in spaced relation from a top surface thereof. The angled bore is for receiving a fastener drivable therethrough into a side face of the one first structural member, through the one first structural member, and into the second structural member therebeneath.

A first embodiment of a method of the present invention is for affixing a decking member to a joist. The method comprises the steps of positioning a base plate atop a pair of decking members positioned in spaced-apart relation from each other atop a joist as above, with the base plate retained in a desired position relative to the decking members. A jig body as above is positioned atop the base plate in a desired orientation. A fastener is driven through the angled bore into a side face of the first decking member, through the first decking member, and into the joist therebeneath.

A second embodiment of the invention comprises a device for affixing a first and a second structural member together, a first face of the first structural member positioned adjacent a first face of the second structural member. The device comprises a jig body positionable adjacent a space adjacent a second face of the first structural member. The second face meets the first face at an angle greater than or equal to 90°.

The jig body has an angled bore having a bottom end extending through a bottom face of the jig body. The bottom end of the angled bore is in communication with the space, and the angled bore defines a centerline extending through the space to a position on the first structural member. The position is on the second face thereof in spaced relation from the first structural member's first face. The angled bore is for receiving a fastener drivable therethrough into the first structural member's second face, through the first structural member's first face, and into the second structural member's first face.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

BRIEF DESCRIPTION OF THE DRAWINGS

FIG. 5B, the creation of the pilot hole; and FIG. 5C, the placement of the fastener.

DETAILED DESCRIPTION OF THE PREFERRED EMBODIMENTS

A description of the preferred embodiments of the present invention will now be presented with reference to FIGS. 1–14. It will be understood by one of skill in the art that the position-related terms are for orientation purposes, and that such words as "top" and "bottom" are relative to the embodiment depicted herein.

The Device

Figure 1:
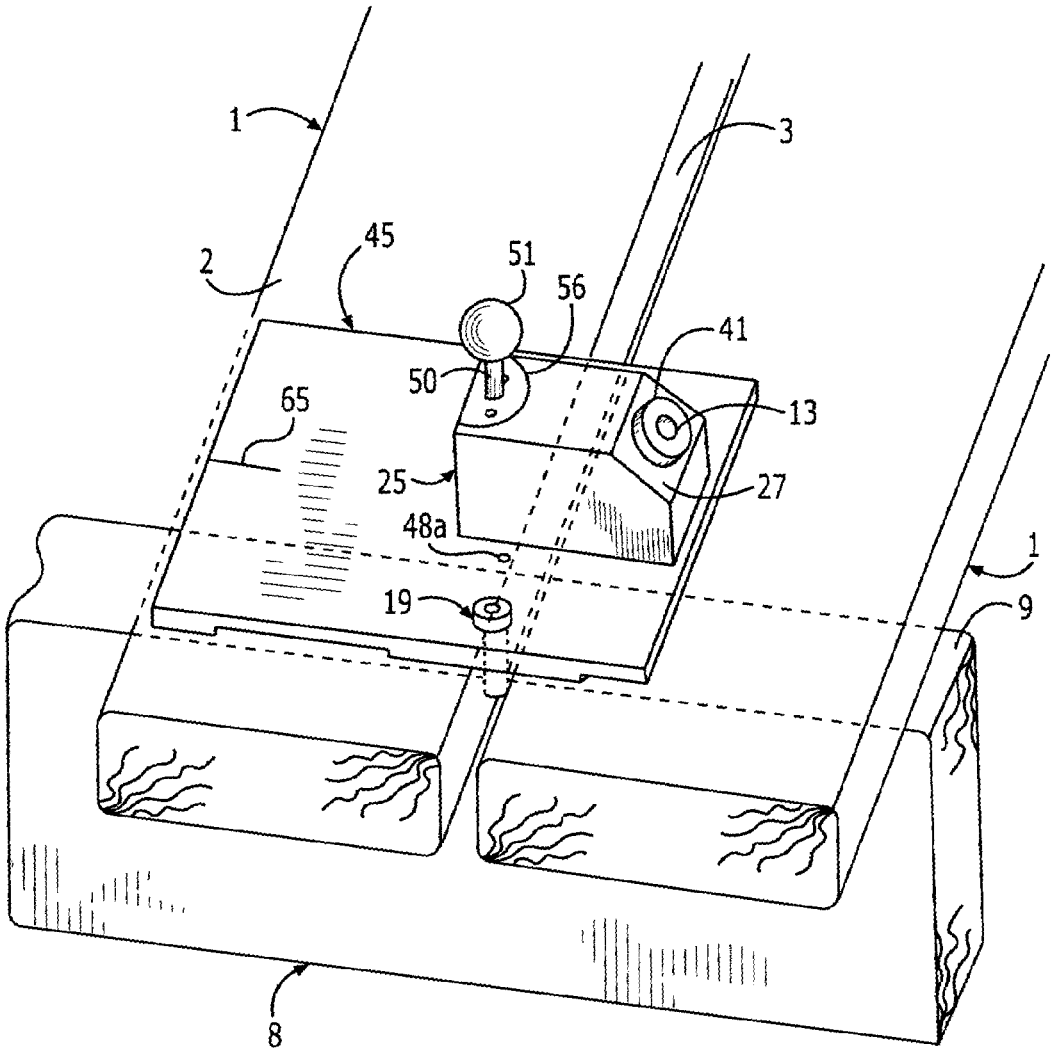
FIG. 1 is a top-side perspective view of the jig device of the present invention positioned atop a pair of adjacent decking members.
Figure 4:
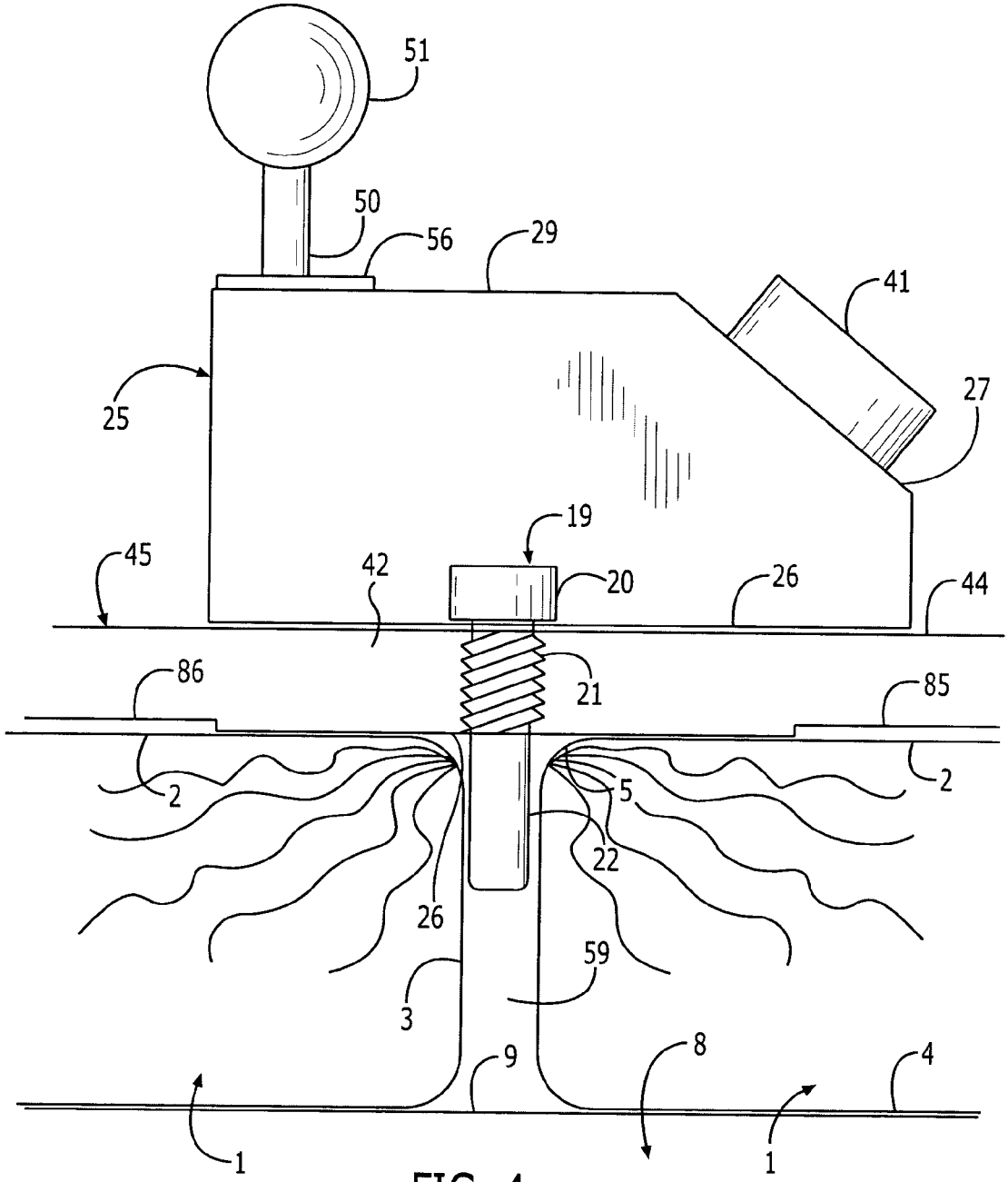
FIG. 4 is a side cross-sectional view of the device of FIG. 1, showing a first index post in position.

FIGS. 1 and 4 are exemplary views of two decking members 1 situated on an upper surface 9 of an underlying supporting joist 8. Adjacent decking members 1 are preferably spaced apart 59 and are preferably separated by a predetermined minimum distance, here, ¼ inch. The jig device 7 of the present invention comprises a jig body 25 and a base plate 45, the bottom face 26 of the jig body 25 coupled atop the top surface 44 of the base plate 45. The base plate 45 is positionable on the surface face 2 of the decking members 1.

The jig body 25 in a preferred embodiment comprises a substantially rectilinear box-like element having a top-front angular face 27 that is approximately perpendicular to the centerline 28. A stepped bore 30 (FIG. 3) extends from the top face 29 through to the bottom face 26, having a smaller diameter 32 adjacent the bottom face 26 than the diameter 33 adjacent the top face 29. An angled bore 49 extends from the angular face 27 to the bottom face 26. The centerline 28 (FIG. 5A) of the bore 49 makes an angle 15 of 45–60°, with a preferred angle of approximately 50°, with the bottom face 26, and hence with the surface face 2 of the decking members 1. A guide sleeve 12 is inserted into the angled bore 49, the guide sleeve 12 having a collar 41 at its top end dimensioned to be retained against the angular face 27. The orientation of the bottom end 14 of the guide sleeve 12 serves to protect the rounded edge 5 of the decking member 1 from being marred during the fastening process, which will be described in the following. In addition, the angle 15 is believed to represent the angle at which adequate purchase of the decking member 1 is attained while minimizing undesired effects of the fastener tip "walking" downward.

Figure 3A:
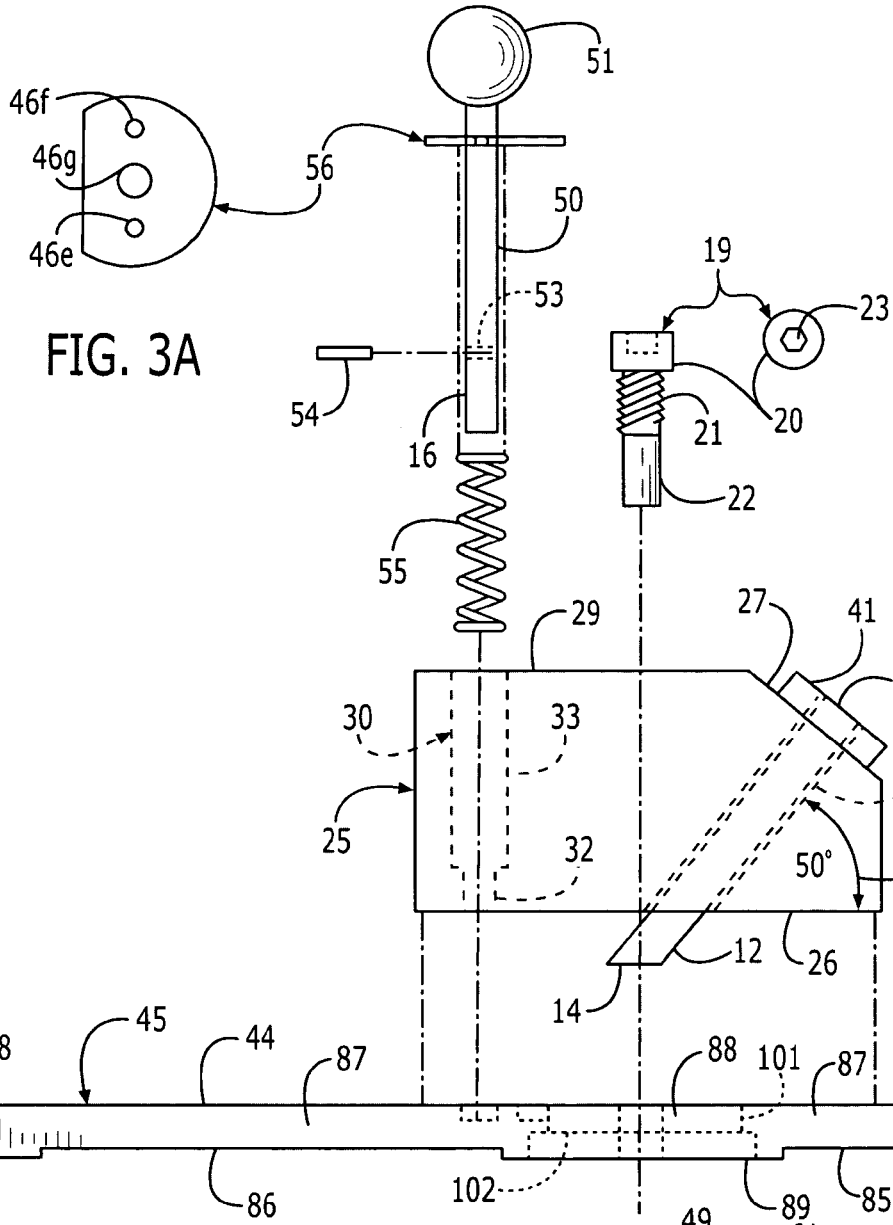
FIG. 3A is a top plan view of the retaining plate.
Figure 3:
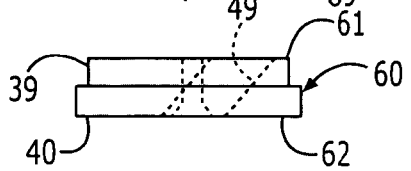
FIG. 3 is an exploded side view of the jig device.

The jig device 7 additionally comprises an exemplary plunger assembly 52, not intended to be limiting, which in turn comprises a compression spring 55 (FIG. 3) dimensioned for insertion into the stepped bore 30 and be retained within the upper portion 79 having the larger diameter 33. A plunger rod 50 having a knob 51 at a top end and a diametric hole 53 between the knob 51 and the bottom end 16 is dimensioned to fit inside the spring 55 and to pass into the stepped bore's lower portion 80. A pin 54 (FIG. 3) fits within the diametric hole 53 to contain the bottom end of the spring 55 on the rod 50 when positioned within the bore 30. A retaining plate 56 (FIG. 3A) has a generally central hole 46*g* dimensioned to pass the rod 50 therethrough and further dimensioned to retain the top end of the spring 55 beneath the retaining plate 56. Two holes 46*e*,46*f* on a diameter of the retaining plate 56 are for receiving screws 57 for attaching the plunger assembly 52 to the jig body 25.

Figure 2A:
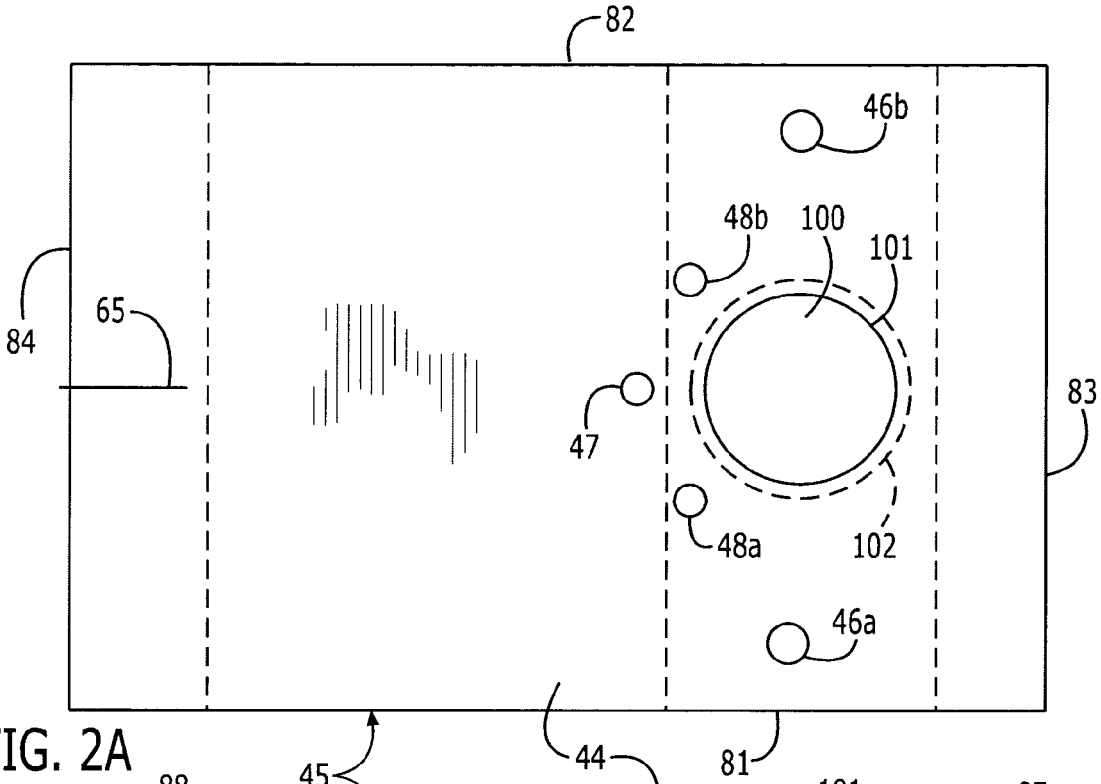
FIG. 2A is a top plan view of the base plate.
Figure 2B:
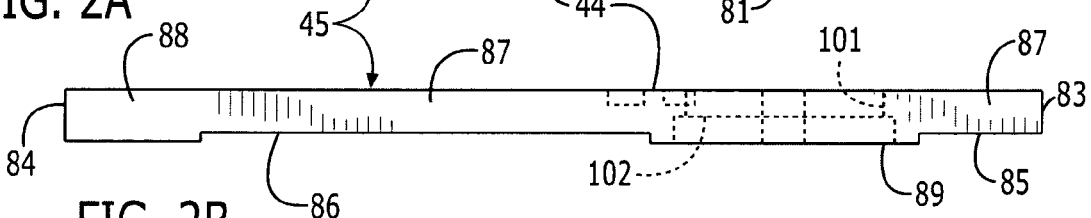
FIG. 2B is a side view of the base plate.
Figure 2C:
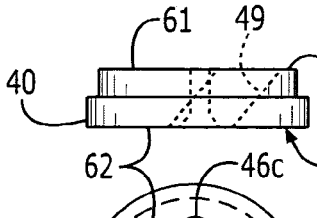
FIG. 2C is a side view of the disc plate.
Figure 2D:
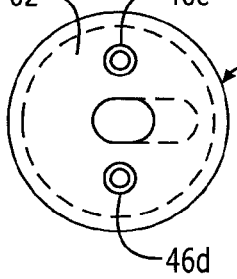
FIG. 2D is a bottom plan view of the disc plate.

The base plate 45 (FIGS. 2A,2B) in a preferred embodiment comprises a substantially rectangular member having a substantially planar top surface 44 and a stepped bottom surface 43. Two substantially parallel channels extend across the bottom surface 43, from a first side edge 81 to a second side edge 82 (FIG. 2A), substantially parallel to a front edge 83 and a rear edge 84 (FIGS. 2A and 2B). A first channel 85 is contiguous with the front edge 83; a second channel 86 is in spaced relation from the rear edge 84. The base plate 45 has a first thickness 87 at the first 85 and second 86 channels and a second thickness 88 adjacent the rear edge 84 and along a strip 89 between the channels 85,86. The channels 85,86 are intended to accommodate the longitudinal crown profile that may be present on the surface face 2 of some types of decking members 1, thereby allowing the present invention to be used on decking members 1 that are either flat or have a crowned profile. Thus the present invention maintains a desired target on the side face 3 (FIG. 5A) of the decking member 1 despite variations in surface contour.

An alignment mark 65 is positioned on the top surface 44 of the base plate 45 (FIG. 2A), extending from and perpendicular to the rear edge 84.

Through holes 46*a*,46*b* are placed along the strip 89. Between holes 46*a*,46*b* is a stepped substantially circular bore 100 (FIGS. 2A and 2B), having a first diameter 101 at the top surface 44 and a second diameter 102 greater than the first diameter 101 at the bottom surface 43. Three partial bores 47,48*a*,48*b* extend from the top surface 44 adjacent the bore 100, with bore 47 above the second channel 86 and bores 48*a*,48*b* above the strip 89 on either side of the bore 47. Bore 47 is substantially collinear with a line 64 perpendicular to the front edge 83 through a center point 66 of the circular bore 100; bores 48*a*,48*b* are at substantially 45° angles from that line 64 relative to the center point 66.

Disc plate 60 (FIGS. 2C,2D) is dimensioned to fit into the stepped bore 100 from below, having a first diameter 39 at the top surface 61 and a second diameter 40 larger than the first diameter 39 at the bottom surface 62. Two holes 46*c*,46*d* are positioned along a diameter of the disc plate 60 and extend from the top surface 61 through to the bottom face 62, where they are chamfered for receiving a screw 63 for attachment to the bottom surface 26 of the jig body 25 (see FIG. 3). An inclined bore 49 is generally centrally located through the disc plate 60 from the top surface 61 through to the bottom surface 62, for permitting the guide sleeve 12 to pass therethrough when the jig body 25 is positioned atop the coupled base plate 45 and disc plate 60.

Figure 9:
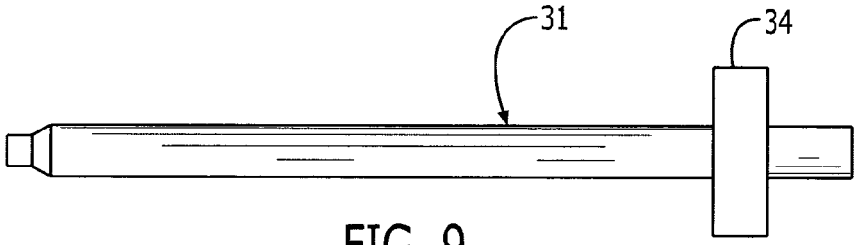
FIG. 9 is a side perspective view of the driver.
Figure 10:
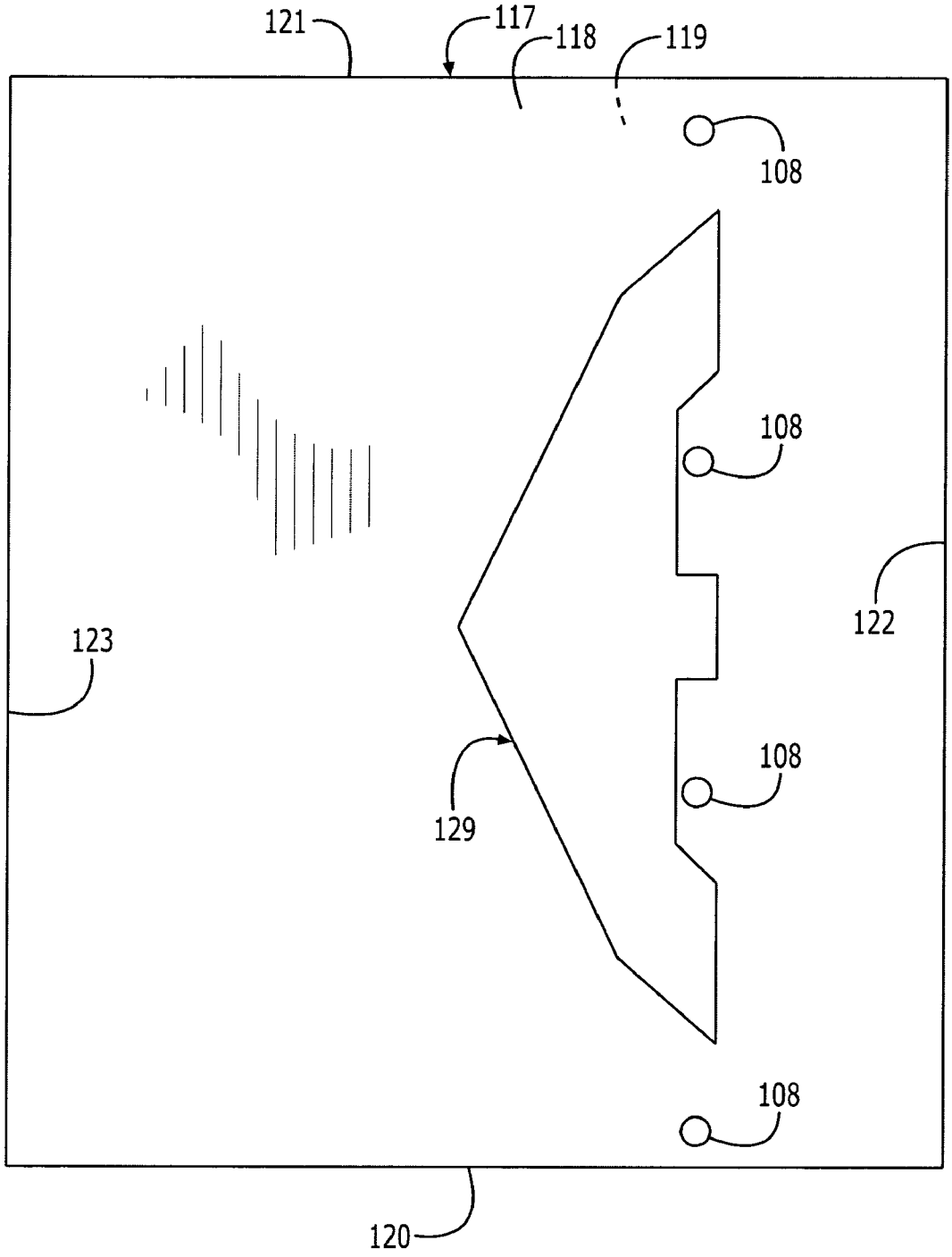
FIG. 10 is a top plan view of the multiple-aperture base plate with viewing window and holes.
Figure 11:
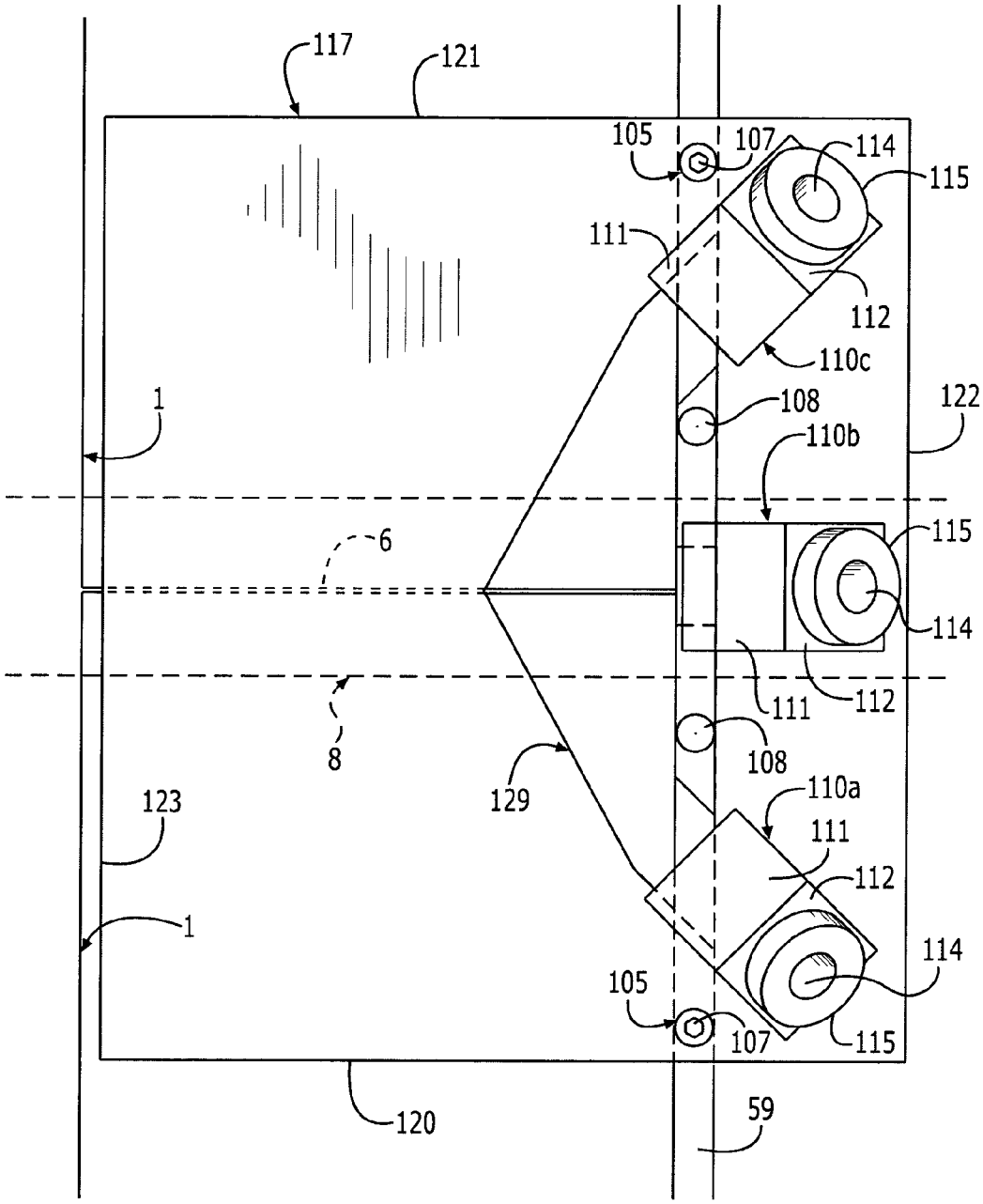
FIG. 11 is a top plan view of the multiple-aperture jig device of the present invention.
Figure 12:
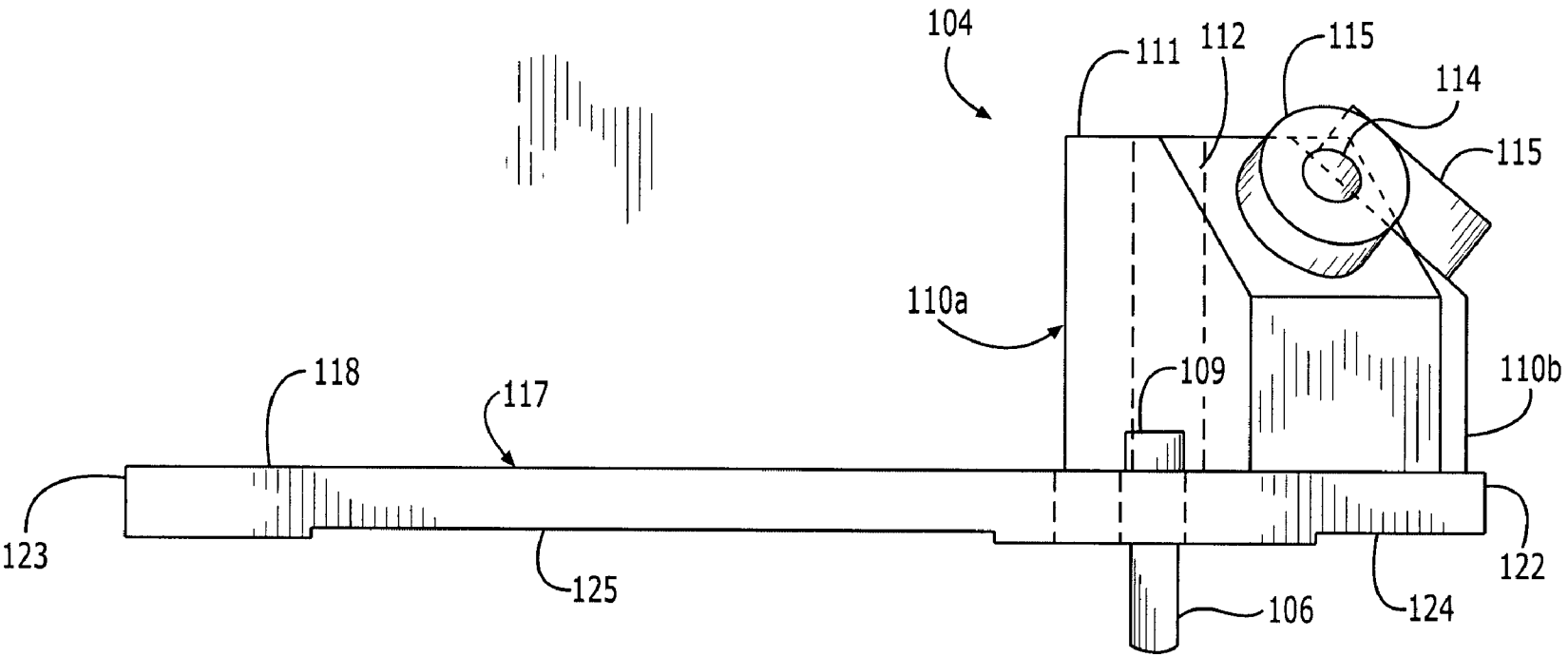
FIG. 12 is a side perspective view of the multiple-aperture jig device.
Figure 13:
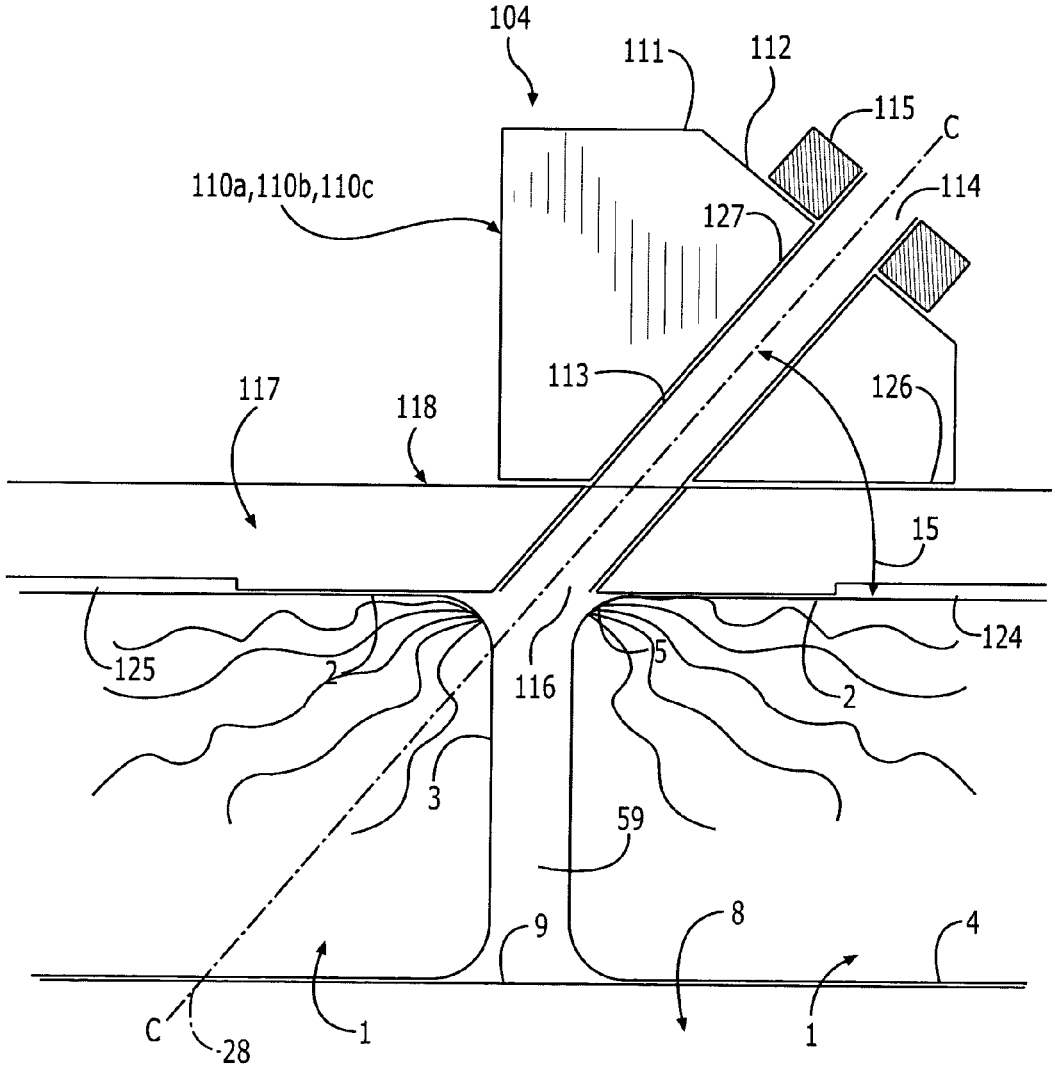
FIG. 13 is a side cross-sectional view of the multiple-aperture jig device.
Figure 14:
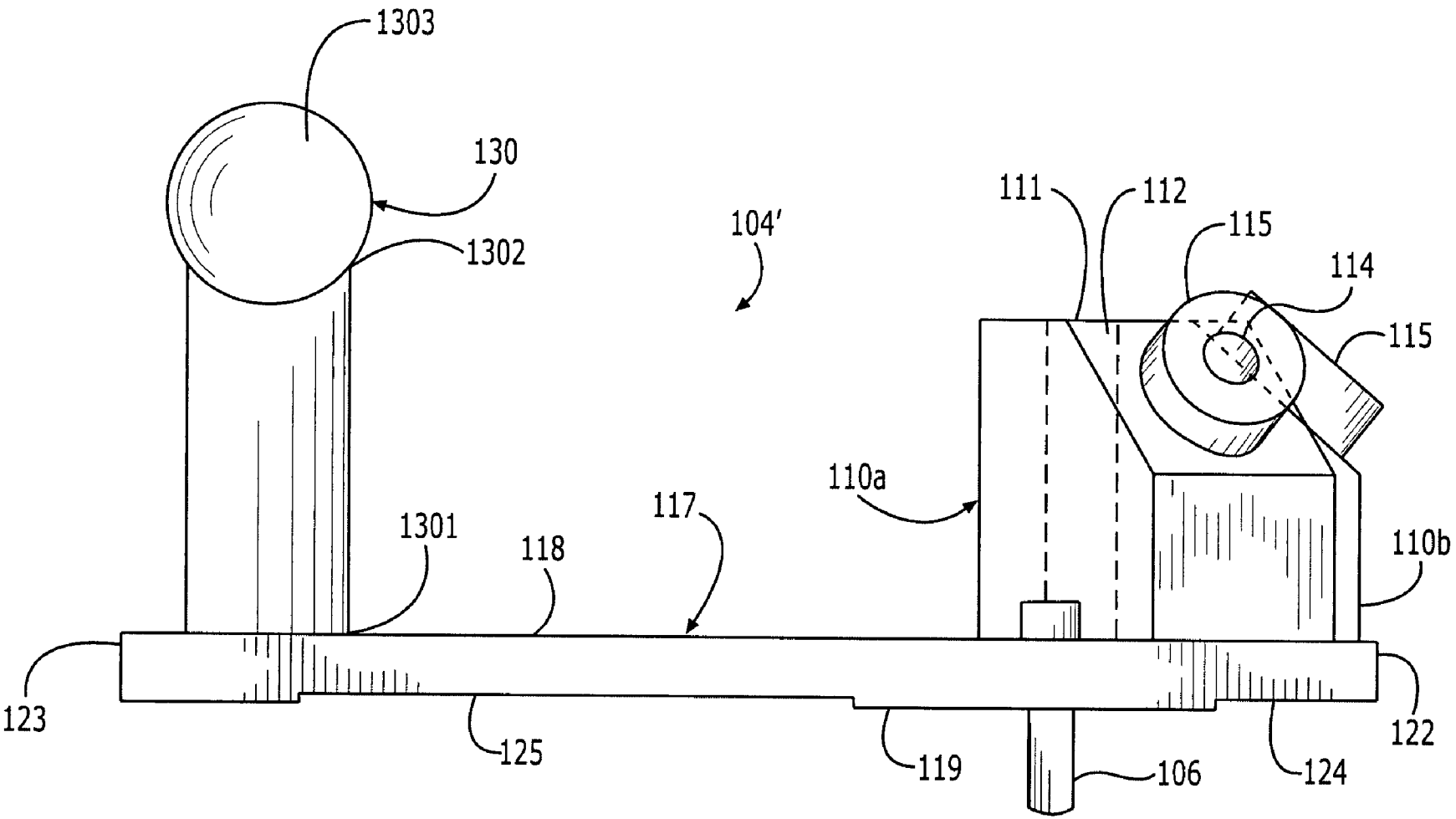
FIG. 14 is a side perspective view of the jig device having a handle.

The jig device 7 further comprises a pair of index posts 19, each insertable through one of the tapped holes 46*a*,46*b* extending through the base plate 45. The index posts 19 each have a head 20, a threaded portion 21, a smooth, non-threaded portion 22, and a recess 23 in the head 20 for receiving a driving device such as, but not limited to, a hexagonal driver such as depicted in FIG. 9. Each index post 19 further has a length 24 extending along the threaded 21 and nonthreaded 22 portions that is greater than a width 42 of the base plate 45. Thus, in use, an index post 19 may be driven through the base plate holes 46*a*,46*b*, the threaded portion 21 engaging the taps of the holes 46*a*,46*b*, and at least a portion of the nonthreaded portion 22 extending beneath the base plate 45 and then between adjacent decking members 1, for retaining the base plate 45 in a desired position relative to the decking members 1.

Preferably the nonthreaded portion 22 of the index posts 19 should have a smaller diameter than the space 59 between adjacent decking members 1, to allow for variations in the dimensions of decking members 1. The threaded portion 21 permits the removal of the jig device 7 during use if needed.

When assembled and positioned atop a pair of decking members 1, the bottom end of the angled bore 49 should be positioned to meet the space 59. The jig body 25 is freely rotatable relative to the base plate 45 by lifting the plunger rod 50 via the plunger knob 51. The bottom end 16 of the plunger rod 50 insertable into any of the three partial bores 47,48*a*,48*b* (see FIGS. 6A,6B), making three locations along the side face 3 of a decking member 1 accessible for inserting a fastener thereinto in a "hidden" or "concealed" fashion, as will be described in the method detailed in the following.

A further embodiment of the device of the present invention is illustrated in FIGS. 10–13. This multiple-apertured (or "fixed") embodiment 104 permits any or all of three fasteners 70 (FIG. 8) to be driven into structural members without having to reposition the jig body. As above, two decking members 1 are situated on an upper surface 9 of an underlying supporting joist 8. Adjacent decking members 1 are preferably spaced apart 59 and are preferably separated by a predetermined minimum distance, here, ¼ inch. The jig device 104 of the present invention comprises three jig bodies 110*a–c* and a base plate 117, the bottom face 119 of the jig bodies 110*a–c* coupled atop the top surface 118 of the base plate 117. The base plate 117 has a viewing window 129 extending therethrough from the top surface 118 through to the bottom surface 119. The viewing window 129 is positioned adjacent to, but not interfering with, holes 108, to permit visualization of the decking member side face 3 at the location toward which the fastener 70 will be aimed. The base plate 117 is positionable on the surface face 2 of the decking members 1.

The jig bodies 110*a–c* in a preferred embodiment are substantially the same as the jig body 25 described above, without the plunger assembly and disc plate, since the positions of the jig bodies 110*a–c* are fixed. The jig bodies 110*a–c* of this embodiment are illustrated with corresponding elements as follows: top-front angular face 112, top face 111, bottom face 126, angled bore 127, centerline 28, guide sleeve 113, guide sleeve collar 115. For the base plate 117: top surface 118, stepped bottom surface 119, first side edge 120, second side edge 121, front edge 122, rear edge 123, first channel 124, second channel 125, viewing window 129 and holes 108. Also included are index posts 105 for insertion through holes 108, having a head 109, nonthreaded portion 106, and recess 107. As will be seen in FIG. 11, the viewing window 129 is configured to permit visualization during use of any of the jig bodies 10*a–c*.

Yet another embodiment (FIG. 14) comprises a jig device 104' as described above, and further comprising a handle 130 having a bottom end 1301 affixed to the base plate 117 and a top end 1302 having a gripping member 1303 affixed thereto. The handle 130 is useful for securing the jig device 104'.

Method of Using the Device

The method of the present invention includes the steps of placing a first decking member 1 substantially horizontally atop a generally transversely oriented supporting joist 8 and placing a second decking member 1' substantially parallel to the first 1, leaving a spacing 59 of at least ¼ inch in a preferred embodiment.

Adequate spacing is necessary to prevent untoward effects caused by moisture retention due to debris trapped between decking members 1, like a sponge effect. Adequate aeration is important to minimize moisture retention and subsequent damage caused thereby, including potential additional damage caused by the pooling of water on the deck surface. Enhanced aeration through and underneath the deck helps to maintain a dry environment, prolonging deck life.

Figure 5A:
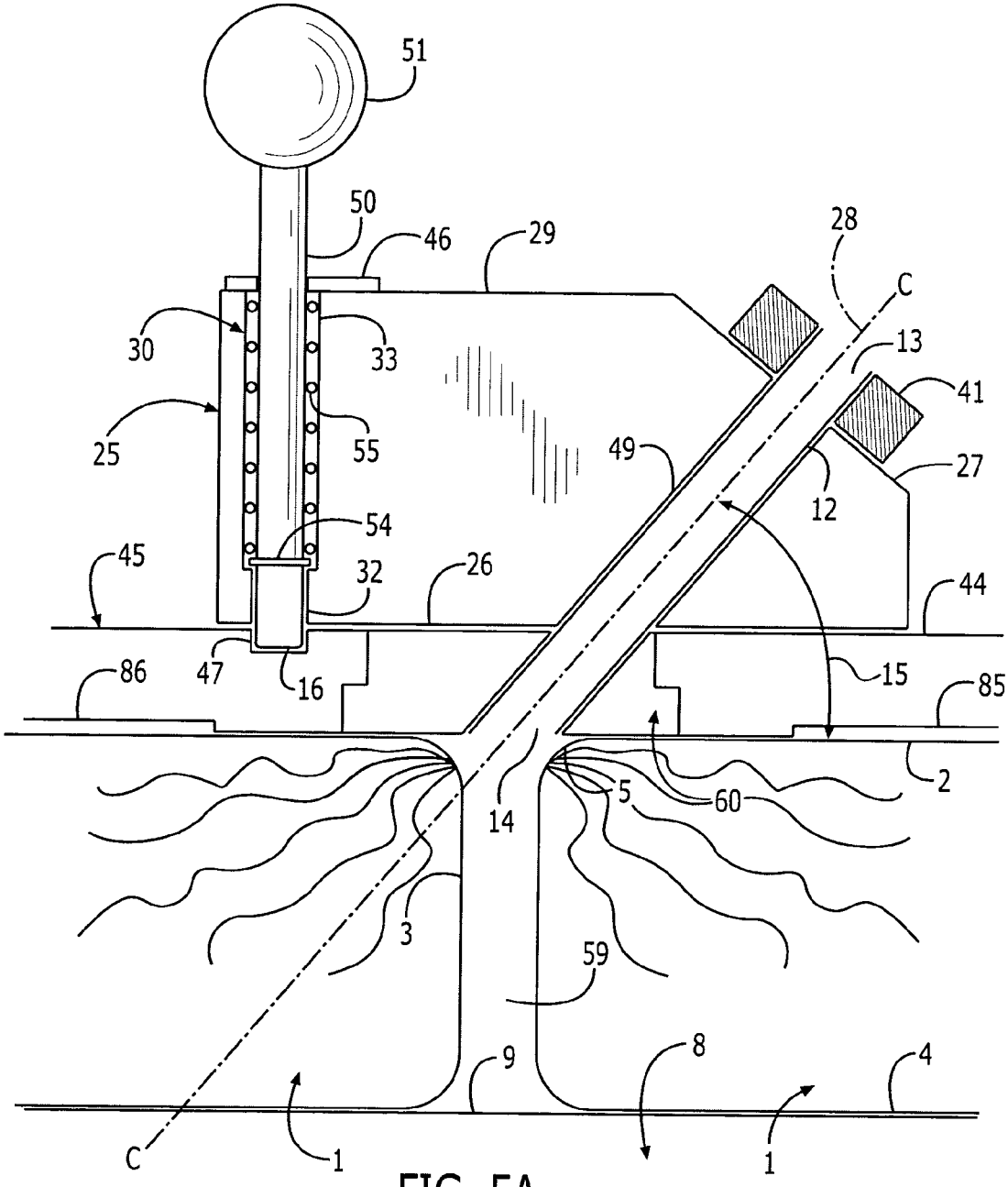
FIGS. 5A–5C are side cross-sectional views of the operation of the device of FIG. 1 in the 90° position, with FIG. 5A illustrating the positioning of the jig device.
Figure 6A:
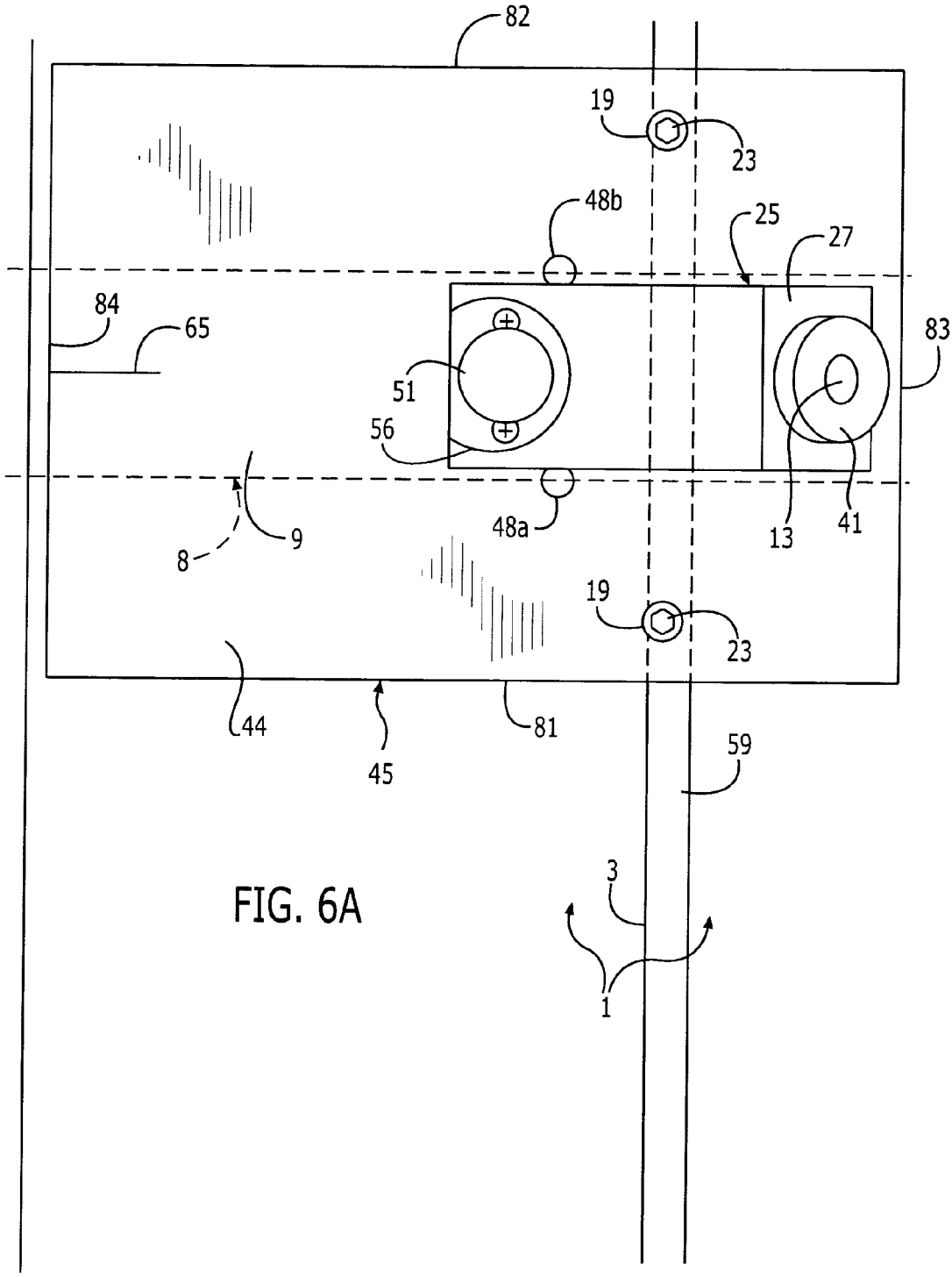
FIGS. 6A and 6B are top plan views of the jig device positioned at the 90° and 45° positions, respectively.

Next the jig device 7 is locked into the 90° position (FIG. 6A) and situated on the surface face 2 of the decking member 1 directly over a supporting joist 8, with the index posts 19 positioned in the space 59, so that the nonthreaded portions 22 are juxtaposed against the side face 3 of the far decking member 1 (FIG. 4). This positioning automatically indexes the desired orientation of the central axis 28 of the guide sleeve 12 toward the target, on the side face 3 of the decking member 1 (FIG. 5A). The alignment mark 65 on the base plate 45 should be aligned with the center 58 of the joist 8 beneath (FIG. 6A). This alignment will ensure that the bottom end 14 of the guide sleeve 12 is positioned directly over the center 58 of the joist 8, which is obscured from view once the jig device 7 is in position.

Figure 5B:
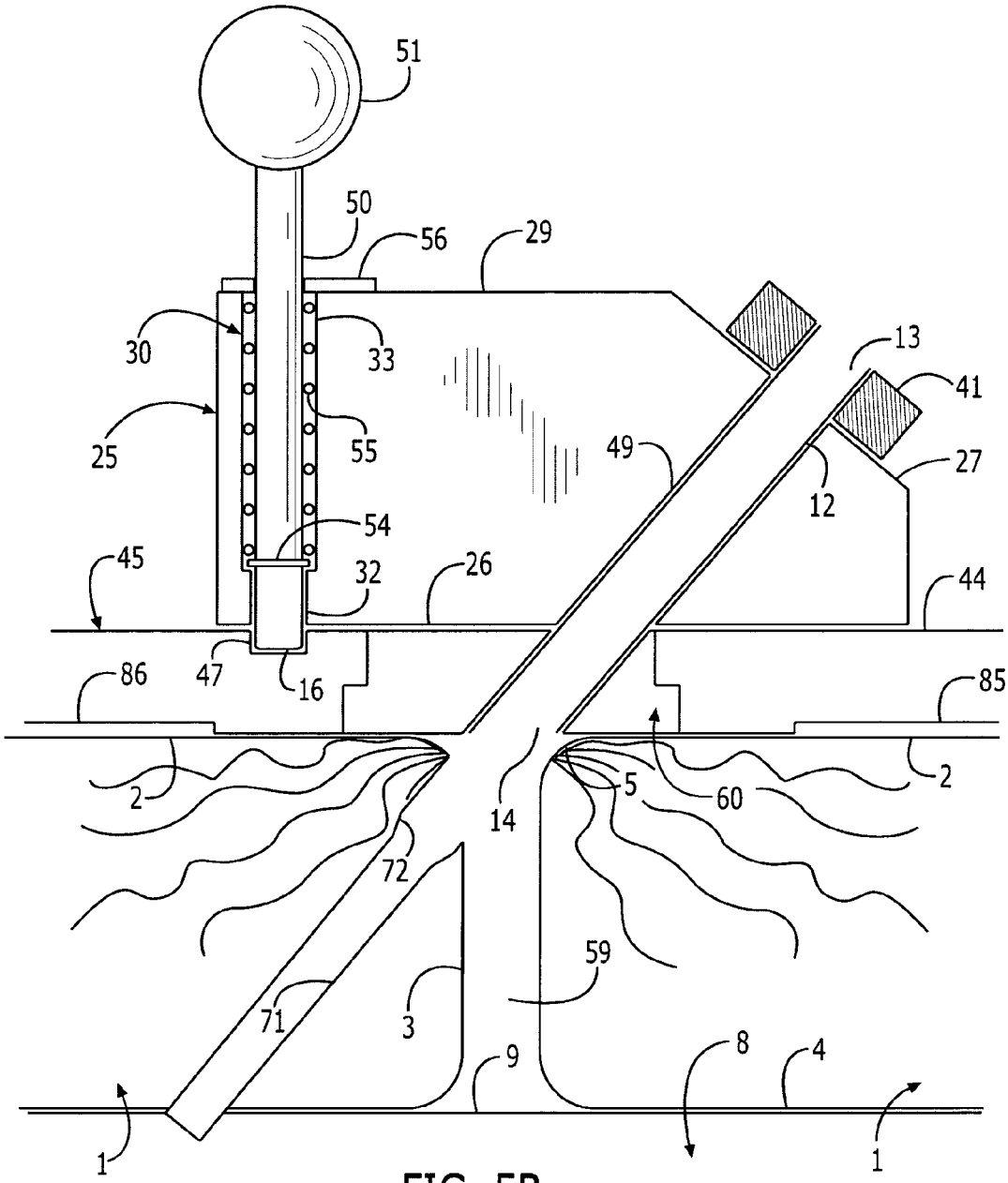
Figure 7:
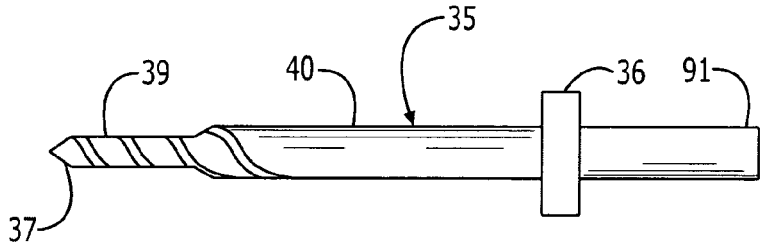
FIG. 7 is a side perspective view of the centering drill bit.
Figure 8:
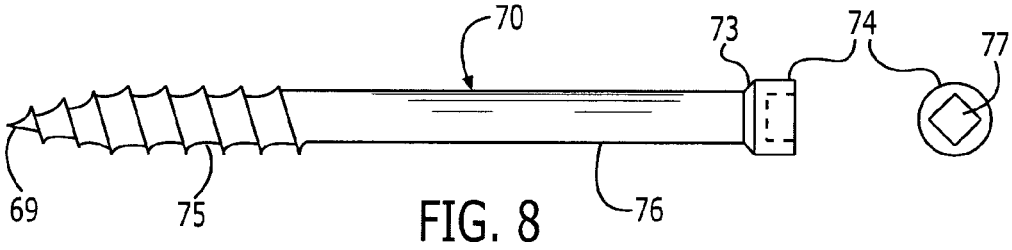
FIG. 8 is a side perspective view of the fastener.

A first embodiment of a method of use is intended for decking member materials that require predrilling of a pilot hole 71. Predrilling minimizes the chance of splitting the decking member 1, or breaking or stripping the head 74 of the fastener 70, especially when using hardwoods. Pressure is applied to the top surface 44 of the base plate 45, such as by the user's knee or foot. A centering drill bit 35 (FIG. 7) is attached to a power drill at a top end 91, introduced into the top end 13 of the guide sleeve 12, and advanced until its distal tip 37 enters the side face 3 of a decking member 1, creating a pilot hole 71 with a chamfered lead-in 72 (FIG. 5B). A desired depth is adjusted by a correct positioning of an adjustable stop collar 36 on the drill bit 35 (FIG. 7). The upper, nonfluted, portion 40, having a larger diameter, matches the internal diameter of the guide sleeve 12, thus keeping the tip 37 of the smaller-diameter, fluted portion 39 properly aligned along the central axis 28 as the drill bit 35 is advanced down the length of the guide sleeve 12.

A specially designed fastener 70 (FIG. 8) is loaded into the top end 13 of the guide sleeve 12, followed by a driver 31 attached to a power drill. The driver 31 advances the fastener 70 until it is properly seated in the predrilled chamferred pilot hole 71.

Figure 5C:
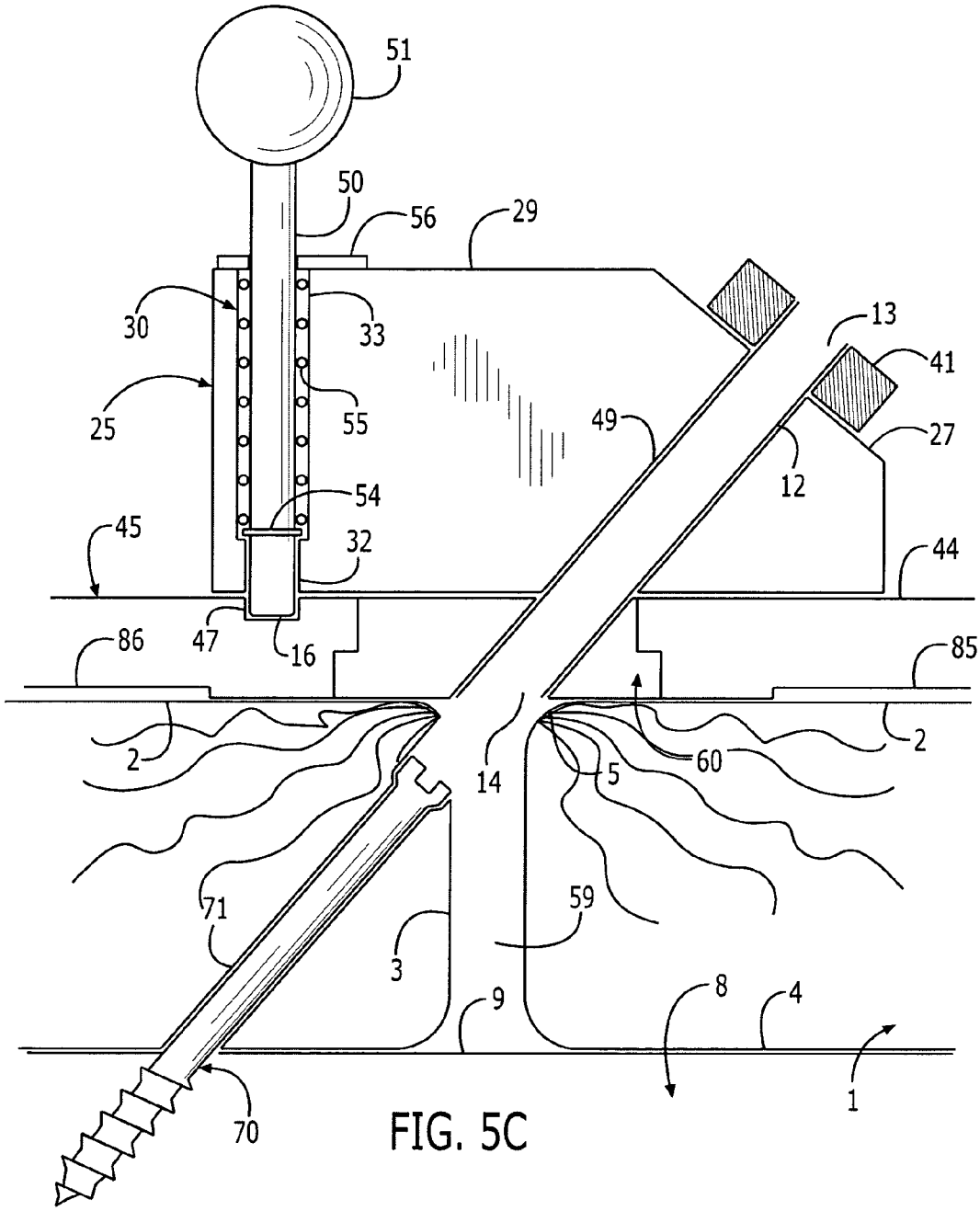

Such a pilot hole 71 and chamfered lead-in 72 allow for the introduction of a lag screw principle, such that the beveled lower surface 73 of the screw head 74 is properly seated in the chamfer 72 and effectively lags the decking member 1 against the supporting joist 8 underneath (FIG. 5C). The special fastener 70 has a head 74 having a drivable top end, such as, but not intended to be limited to, a square recess 77, a nonthreaded portion 76 beneath the head 74, and a threaded portion 75 extending to the tip 69. The fastener 70 is configured such that the outer diameter of the head 74 and the threads 75 are substantially the same dimension, which effectively maintains the tip 69 of the fastener 70 along the central axis 28 as it passes down the length of the guide sleeve 12.

Preferably the nonthreaded portion 76 has a length 78 sufficient that the decking member 1 is lagged to the supporting joist 8 (FIG. 5C). It is desirable to avoid cross-threading, as this will result in insecure attachment and an uneven surface of the finished deck. This is obviated by positioning the threaded portion 75 of the fastener 70 entirely within the joist 8.

A second embodiment of a method of use is intended for decking member materials that do not require predrilling of a pilot hole. Pressure is applied to the top surface 44 of the base plate 45, such as by the user's knee or foot. A fastener 70 is loaded into the top opening 13 of the guide sleeve 12, followed by the driver 31 attached to a power drill. The driver 31 advances the fastener 70 until it is properly seated, as determined by the stop collar 34 on the driver 31.

As alluded to above, the appropriate angle 15 is an important feature of the present invention, since it represents an appropriate orientation such that the fastener 70 has adequate access to the side face 3 of the decking member 1 through the space 59 between decking members 1. As mentioned, an angle 15 above the desired range can subject the fastener 70 to walking downward and to inadequate purchase; an angle 15 less than the desired range creates less access to the side face 3, because the central axis 28 becomes more tangential, thereby being exposed to a more narrow opening to the target. In addition, an angle 15 less than the desired range causes the fastener 70 to travel through more substance in the decking member 1, with resulting less length of the fastener 70 extending out the bottom face 4 before engaging the joist 8.

Another important feature of the present invention is that the bottom end 14 of the guide sleeve 12 is oriented such that it protects the rounded edge 5 of the decking member 1 from being marred during the predrilling step and/or the fastener 70 driving step.

Figure 6B:
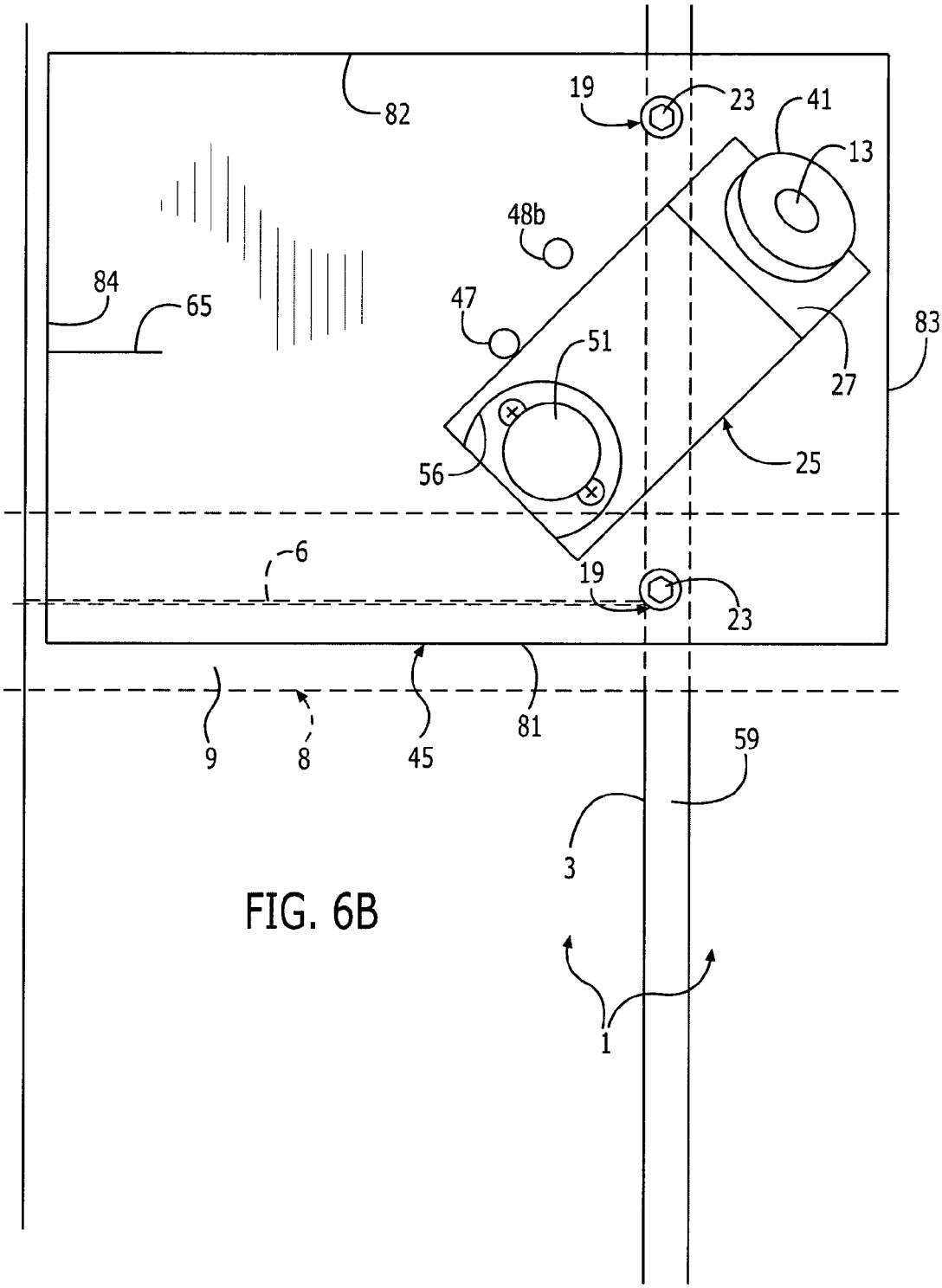

As shown in FIG. 6B, the device 7 can be rotated to one of the 45° positions and locked in place in preparation for fastening a cut end of a decking member 1 or a butt joint 6. In order to rotate the jig body 25 to the desired position (FIGS. 6A,6B), the plunger knob 51 is pulled upward, disengaging the bottom end 16 of the plunger rod 50 from the respective bore 47,48*a*,48*b*, and rotating in a desired direction. When the plunger knob 51 is released, the compression spring 55 forces the bottom end 16 of the plunger rod 50 into the desired bore to lock the jig body 25 into the desired position. This permits the user to adjust for the appropriate distance from cut ends or for butt joints 6 for the fastener 70, so as to prevent splits from developing in the decking member 1 caused by placing the fastener 70 too close to a cut end.

In another embodiment, an automated mechanism for delivering collated fasteners 70 is used in concert with the device, which would enhance the efficiency of the system. In this embodiment there is no base plate; only the jig body 25 would be used. In order to emphasize that the orientation is substantially irrelevant, a first face of the first structural member 1 comprises the bottom face 4; a second face of the first structural member 1 comprises the side face 3; and a first face of the second structural member 8 comprises the upper surface 9 of the second structural member. This embodiment can also be used in other applications, and this use is not intended as a limitation.

The devices and methods of the present invention provide for a secure fastening means such that the decking members 1 are directly attached to supporting joists 8 and not via indirect means. Because the fastener 70 directly attaches the decking member 1 to the supporting joist 8, subsequent shrinkage does not compromise secure fixation in the future, consequently there is no loosening.

Often it is necessary to be able to remove an individual decking member 1 once installed and without destroying it on removal. Decking members 1 can become damaged, undetected splits can propagate, or it may be desired to install electrical or water drainage under the deck. With the system of the present invention, individual decking members 1 can be easily removed and replaced by merely unscrewing the fasteners 70.

In a preferred embodiment, comprising the multiple-aperture device 104, the viewing window 129 (FIGS. 11 and 12) in the base plate 117 permits visualization of the fastener 70 placement, thereby optimizing placement by, for example, avoiding knots. The window 129 also permits the fastener 70 to be lined up with the screw hole when replacing decking members 1.

Other systems known in the art require that a decking member be cut up for removal, and reinstallation requires reattachment through the surface face 2.

Because the system of the present invention indexes off the top surface 2 of the decking member 1, it can be used with any (2× and 1×) dimension materials. Some of other known systems are limited to use with thicker (2×) materials. This system is amenable for use with hardwoods, softwoods, polymeric, and composite materials. The system also addresses the securing of butt joints and is compatible with both the perpendicular and diagonal orientation of decking members 1 relative to the supporting joists 8.

The system also does not require that decking members 1 be completely fastened in sequence prior to installation of the next decking member 1. In many cases, for example, it may be desirable to preplace decking members 1 with several fasteners 70 in order to maintain them in the proper position prior to setting the next decking member 1. This provides a safer work environment, and also permits the final fastening on the deck surface rather than from the ground level, which can be uneven and distant from the deck surface.

Since the present system and method do not involve the impaling or cutting of a kerf, shrinkage of deck members 1 does not compromise the long-term fixation, as can occur with other known systems using indirect fixation.

Finally, the present system and method are advantageous as the user can apply decking members from atop the deck surface, permitting the user to work in an upright position and not upside down. Typically the user can either use the knee or foot to maintain the device in position during operation; alternatively, a handle 130 can be gripped by the user in order to maintain placement of the device.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the device and method illustrated and described herein are by way of example, and the scope of the invention is not limited to the exact details of construction.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A device for affixing a first structural member to a second structural member, the first structural member positioned atop the second structural member, the device comprising:

a base plate positionable atop a pair of first structural members positioned in spaced-apart relation from each other, the base plate having a bore therethrough from a top surface to a bottom surface;

means for retaining the base plate in a desired position relative to the first structural members so that the base plate bore is in communication with a space between the pair of first structural members; and a jig body positionable atop the base plate in a desired orientation, the jig body having an angled bore having a bottom end extending through a bottom face of the jig body, the angled bore in communication with the base plate bore, the angled bore, when the jig body is in the desired orientation, defining a centerline extending to a position on a one of the first structural members in spaced relation from a top surface thereof, for receiving a fastener drivable through the angled bore into a side face of the one first structural member, through the one first structural member, and into the second structural member therebeneath.

2. The device recited in claim 1, wherein the base plate is positionable atop elongated decking members positioned generally parallel to each other and generally perpendicular to the joist, the decking members having generally coplanar top surfaces and being spaced apart by a predetermined spacing.

3. The device recited in claim 2, wherein the base plate has a hole therethrough positioned to communicate with the spacing, the base plate hole positioned spaced apart from the jig body, and the retaining means comprises an index post insertable through the base plate hole, a lower portion of the index post depending into the spacing.

4. The device recited in claim 3, wherein the base plate hole is tapped and the index post has a head, a threaded portion beneath the head, and a nonthreaded portion beneath the threaded portion, the threaded portion engageable with the base plate hole, the nonthreaded portion depending into the spacing for preventing a rotation of the base plate relative to the decking members.

5. The device recited in claim 4, wherein the base plate hole comprises a pair of base plate holes positioned on either side of the jig body adjacent respective side edges of the base plate and the index post comprises a pair of index posts, one index post positionable in each of the base plate holes.

6. The device recited in claim 2, wherein the base plate further has a viewing window therethrough extending from the top surface to the bottom surface, the viewing window positioned forward of the angled bore bottom end to permit visualization of the one decking member side face.

7. The device recited in claim 2, wherein the jig body is retainable in one of a plurality of positions relative to the base plate.

8. The device recited in claim 7, wherein:

the base plate further has a plurality of positioning bores extending from the top surface; and the jig body has a positioning means movable between a released position above the base plate top surface and an engaged position within one of the base plate positioning bores, the positioning means biased to the engaged position.

9. The device recited in claim 8, wherein:

the jig body has a stepped bore extending from a top face through to the bottom face, the stepped bore having a smaller diameter along a lower portion adjacent the jig body top face than a larger diameter along an upper portion adjacent the jig body bottom face;

the positioning means comprises:

a compression spring positionable and retainable within the stepped bore upper portion;

a plunger rod insertable through the spring and dimensioned to pass through the stepped bore lower portion into a positioning bore, the spring positioned to bias the plunger rod to the engaged position, the plunger rod liftable to disengage the plunger rod from the positioning bore.

10. The device recited in claim 9, wherein the positioning means further comprises a pin insertable through the plunger rod, the pin dimensioned to limit a travel of the plunger rod downward beyond a predetermined extent.

11. The device recited in claim 10, wherein the positioning means further comprises a retaining plate affixed to the jig body top face in surrounding relation to the plunger rod and dimensioned to retain the spring within the stepped bore.

12. The device recited in claim 10, further comprising a plunger knob atop the plunger rod to facilitate a grasping of the plunger rod.

13. The device recited in claim 8, wherein the bore comprises a generally circular bore and the positioning bores comprise a first, a second, and a third partial bore, the first partial bore substantially collinear with a line perpendicular to a front edge of the base plate and extending through a center point of the circular bore, the first partial bore located farther from the front edge than the circular bore, and the second and the third partial bores are located on either side of the first partial bore at approximately 45 degrees from the line relative to the circular bore center point.

14. The device recited in claim 2, further comprising a substantially cylindrical guide sleeve extending through the angled bore and having a bottom end protruding beneath the angled bore.

15. The device recited in claim 14, wherein the guide sleeve further has a substantially toroidal collar at a top end thereof, the collar positioned outside a top end of the angled bore.

16. The device recited in claim 2, further comprising a disc plate having a stepped diameter, a first diameter adjacent a top surface and a second diameter larger than the first diameter adjacent a bottom surface, the disc plate having an angled bore therethrough from the top surface to the bottom surface, the angled bore in communication and collinear with the jig body angled bore centerline, wherein the base plate bore is stepped to admit the disc plate rotatably thereinto, and further comprising means for affixing the disc plate to the jig body.

17. The device recited in claim 2, wherein the angled bore centerline forms an angle with a bottom surface of the jig body, the angle in a range of 45 to 60 degrees.

18. The device recited in claim 17, wherein the angle comprises approximately 50 degrees.

19. The device recited in claim 2, wherein the base plate bottom surface has a channel extending thereacross from a first side edge to a second side edge opposed to the first side edge, the channel for accommodating an uneven top surface of a decking member.

20. The device recited in claim 2, further comprising a handle having a bottom end affixed to the base plate top surface in spaced relation from the jig body and an upper end having means for gripping.

21. A system for affixing a decking member to a joist comprising:

a base plate positionable atop a pair of decking members positioned in spaced-apart relation from each other atop a joist, the base plate having a bore therethrough from a top surface to a bottom surface;

means for retaining the base plate in a desired position relative to the decking members so that the base plate bore is in communication with a space between the pair of first structural members;

a jig body positionable atop the base plate in a desired orientation, the jig body having an angled bore having a bottom end extending through a bottom face of the jig body, the angled bore in communication with the base plate bore; and a fastener drivable through the angled bore, when the jig body is in the desired orientation, into a side face of the first decking member, through the first decking member, and into the joist therebeneath.

22. The system recited in claim 21, wherein the fastener comprises a screw having a head, a nonthreaded portion extending beneath the head, a threaded portion extending beneath the nonthreaded portion, and a tip at an end of the threaded portion, the nonthreaded portion dimensioned to extend through the first decking member, the threaded portion for extending into the joist.

23. The system recited in claim 22, wherein the fastener head has a beveled lower surface.

24. A method of affixing a decking member to a joist comprising the steps of:

positioning a base plate atop a pair of decking members positioned in spaced-apart relation from each other atop a joist, the base plate having a bore therethrough from a top surface to a bottom surface;

retaining the base plate in a desired position relative to the decking members;

positioning a jig body atop the base plate in a desired orientation, the jig body having an angled bore having a bottom end extending through a bottom face of the jig body, the angled bore in communication with the base plate bore, the bottom end of the angled bore in communication with a space between the pair of decking members, the angled bore defining a centerline extending to a position on a first decking member in spaced relation from a top surface thereof; and driving a fastener through the base plate bore and the angled bore into a side face of the first decking member, through the first decking member, and into the joist therebeneath.

25. The method recited in claim 24, further comprising the steps, prior to the base plate positioning step, of positioning the decking members generally parallel to each other and generally perpendicular to the joist, the decking members having generally coplanar top surfaces and being spaced apart by a predetermined spacing.

26. The method recited in claim 24, wherein the retaining step comprises inserting an index post through a hole in the base plate, a lower portion of the index post depending into the spacing.

27. The method recited in claim 24, wherein the retaining step comprises retaining the jig body in one of a plurality of positions relative to the base plate.

28. The method recited in claim 24, wherein the angled bore centerline forms an angle with a bottom surface of the jig body, the angle in a range of 45 to 60 degrees.

29. The method recited in claim 28, wherein the angle comprises approximately 50 degrees.

30. The method recited in claim 24, wherein the fastener comprises a screw having a head, a nonthreaded portion extending beneath the head, a threaded portion extending beneath the nonthreaded portion, and a tip at an end of the threaded portion, the nonthreaded portion dimensioned to extend through the first decking member, the threaded portion for extending into the joist.

31. The method recited in claim 24, further comprising the step, prior to the fastener driving step, of advancing a centering drill bit through the angled bore and into the first decking member to form a pilot hole.

32. The method recited in claim 31, wherein the centering drill bit has a distal tip, a fluted portion extending proximal of the tip, a nonfluted portion extending proximal of the fluted portion, the fluted portion and a distal section of the fluted portion having a first diameter larger than a second diameter of a proximal section of the fluted portion, for forming a pilot hole with a chamferred lead-in.

33. A device for affixing a first and a second structural member together, a first face of the first structural member positioned adjacent a first face of the second structural member, the device comprising a jig body positionable adjacent a space adjacent a second face of the first structural member, the second face meeting the first face at an angle greater than or equal to 90°, the jig body having an angled bore having a bottom end extending through a bottom face of the jig body, the bottom end of the angled bore in communication with the space, when the jig body is positioned adjacent the space, the angled bore defining a centerline extending through the space to a position on the first structural member on the second face thereof in spaced relation from the first structural member first face, the angled bore for receiving a fastener drivable therethrough into the first structural member second face, through the first structural member first face, and into the second structural member first face.

34. The method recited in claim 24, wherein the fastener has a drivable top end, and wherein the fastener-driving step comprises applying rotation to the fastener with a driver mated to the drivable top end.

35. The method recited in claim 24, wherein the fastener comprises a head and a threaded portion drivable into the joist, and wherein an outer diameter of the head is substantially the same as an outer diameter of the threaded portion.

36. A device for affixing a first structural member to a second structural member, the first structural member positioned atop the second structural member, the device comprising:

a base plate positionable atop a pair of first structural members positioned in spaced-apart relation from each other, the base plate having a pair of bores therethrough from a top surface to a bottom surface;

means for retaining the base plate in a desired position relative to the first structural members, so that the base plate bore is in communication with a space between the pair of first structural members; and a pair of jig bodies affixed in different orientations atop and relative to the base plate, each of the jig bodies each having an angled bore having a bottom end extending through bottom faces of the jig bodies, the angled bores in communication with a respective one of the base plate bores, the angled bore, when the jig body is in the desired orientation, in communication with the space for receiving a fastener drivable therethrough into a side face of the one first structural member, through the one first structural member, and into the second structural member therebeneath.

37. The device recited in claim 36, wherein the first structural members comprise elongated decking members and the second structural member comprises a joist, the decking members positioned generally parallel to each other and generally perpendicular to the joist, the decking members having generally coplanar top surfaces and being spaced apart by a predetermined spacing.

38. The device recited in claim 37, further comprising a pair of substantially cylindrical guide sleeves extending through the angled bores and having bottom ends protruding beneath the angled bores.

39. The device recited in claim 38, wherein the angled bore centerline forms an angle with a bottom surface of the jig body, the angle in a range of 45 to 60 degrees.

40. The device recited in claim 39, wherein the angle comprises approximately 50 degrees.

41. The device recited in claim 37, wherein the base plate further has a viewing window therethrough extending from the top surface to the bottom surface, the viewing window positioned forward of the angled bore bottom ends to permit visualization of the one decking member side face.

42. The device recited in claim 37, further comprising a handle having a bottom end affixed to the base plate top surface in spaced relation from the jig bodies and an upper end having means for gripping.

43. A method of affixing a decking member to a joist comprising the steps of:

positioning a base plate atop a pair of decking members positioned in spaced-apart relation from each other atop a joist, the base plate having a pair of bores therethrough from a top surface to a bottom surface;

retaining the base plate in a desired position relative to the decking members positioning a pair of jig bodies atop the base plate in different orientations, the jig bodies each having an angled bore having a bottom end extending through a bottom face of the jig body, the angled bores in communication with a respective base plate bore, at least a one of the bottom ends of the angled bores in communication with a space between the pair of decking members, the angled bore in communication with the space defining a centerline extending to a position on a first decking members in spaced relation from a top surface thereof; and driving a fastener through the angled bore in communication with the space into a side face of the first decking member, through the first decking member, and into the joist therebeneath.

44. The method recited in claim 43, wherein the fastener comprises a head and a threaded portion drivable into the joist, and wherein an outer diameter of the head is substantially the same as an outer diameter of the threaded portion.

* * * * *